United States Patent [19]

Mizunuma

[11] Patent Number: 4,813,670

[45] Date of Patent: Mar. 21, 1989

[54] HAND HELD GAME INSTRUMENT

[75] Inventor: Masanori Mizunuma, Tokyo, Japan

[73] Assignee: Tomy Kogyo Co., Inc., Tokyo, Japan

[21] Appl. No.: 176,295

[22] Filed: Mar. 31, 1988

[30] Foreign Application Priority Data

Oct. 15, 1987 [JP] Japan ..... 62-157981

[51] Int. Cl.[4] ..... A63F 9/00

[52] U.S. Cl. ..... 273/1 GG; 446/368

[58] Field of Search ..... 273/1 GG, 148 R; 446/366, 368, 376, 384

[56] References Cited

U.S. PATENT DOCUMENTS

| | | | |
|---|---|---|---|
| 3,050,902 | 8/1962 | Glass et al. | 446/368 |
| 3,578,319 | 5/1971 | Kohner et al. | 273/1 GG |
| 4,469,327 | 9/1984 | Ulrich et al. | 273/1 GG |
| 4,703,892 | 11/1987 | Nadel | 446/368 |

FOREIGN PATENT DOCUMENTS

| | | | |
|---|---|---|---|
| 1544391 | 4/1979 | United Kingdom | 273/1 GG |

*Primary Examiner*—Paul E. Shapiro

*Attorney, Agent, or Firm*—Staas & Halsey

[57] ABSTRACT

A hand held game instrument including a plurality of arm members connected to pivot about a grip member so that a head portion of the instrument engages a protrusion on the grip member causing objects in the head member to drop into a receptacle on the grip member.

4 Claims, 2 Drawing Sheets

HAND HELD GAME INSTRUMENT

BACKGROUND OF THE INVENTION

The present invention relates to a hand held game instrument, and more particularly to a hand held toy used with small marbles or balls. There are toys, typically in the shape of a snake, that have a body comprising a plurality of cylindrical members rotatable with respect to each other. However, such toys are normally intended for children of very young ages, and have no mechanisms for picking-up or holding objects. There are games for small children involving, as an object, picking-up small balls or marbles. These games, however, typically require that the children have a great deal of manual dexterity to successfully play the game. Small children do not have the manual dexterity necessary to play these games, and therefore quickly loose interest in the game.

SUMMARY OF THE INVENTION

It is an object of the present invention to provide a hand held game instrument easily usable by small children.

It is another object of the present invention to provide a hand held game instrument capable of easily picking-up and holding objects.

It is a further object of the present invention to provide a hand held game instrument which does not require a great deal of manual dexterity to operate.

To achieve the above and other objects, the present invention provides a hand held game instrument comprising a grip member, a receptacle connected to the grip member, a protrusion connected to the grip member, an open/close member comprising a first part and a second part pivotable with respect to the first part, and a plurality of arm members pivotally connected to each other, and connected between the grip member and the open/close member so that the open/close member pivots so as to engage the protrusion and to move the second part.

DESCRIPTION OF THE PREFERRED EMBODIMENT

Figure 1:
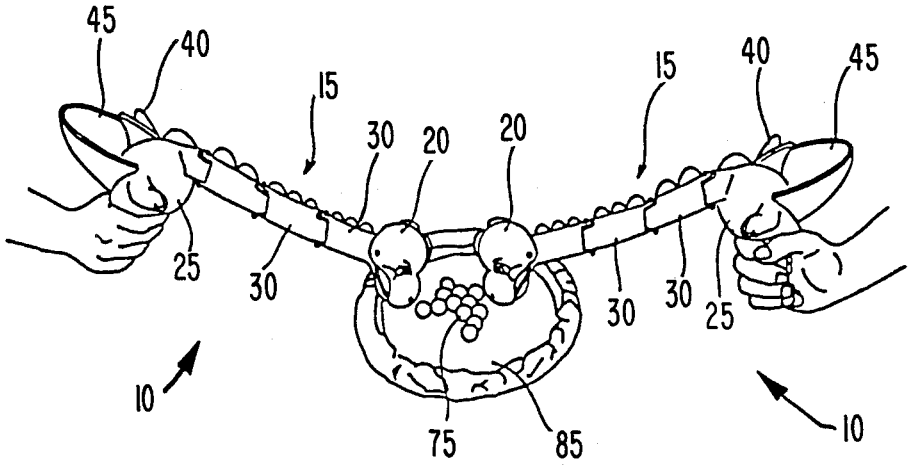
FIG. 1 is a perspective view of two game instruments embodying the present invention.
Figure 2:
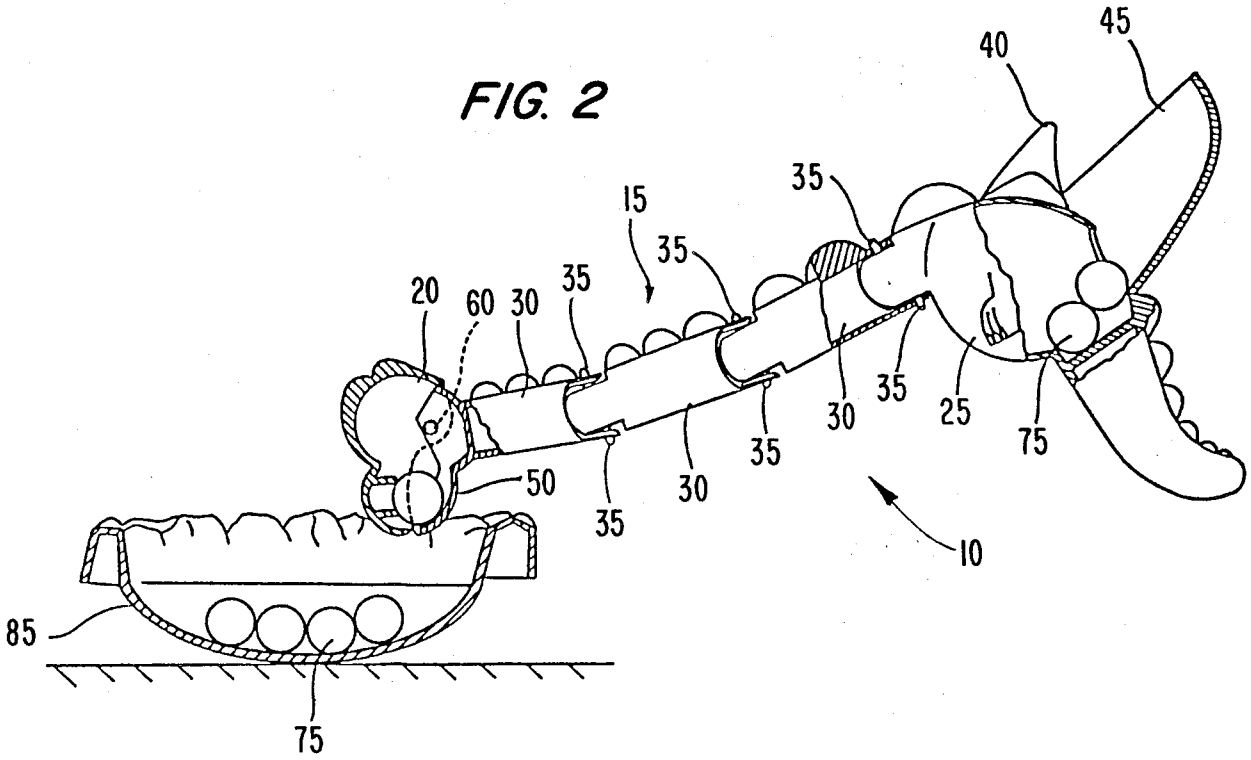
FIG. 2 is a partial, cross-sectional view of a game instrument embodying the present invention.

FIG. 1 is a perspective view of two game instruments, each embodying the present invention. In FIG. 1, a game instrument 10 includes an arm assembly 15 connected between an open/close member 20 and a grip member 25. As shown in FIG. 2, the arm assembly 15 comprises a plurality of arm members 30 pivotally connected to each other by way of pins 35. The arm assembly 15, and more particularly, the arm members 30 are also connected between the open/close member 20 and a grip member 25. The arm members 30 can have any shape. As shown in the illustrated embodiment, the arm members 30 have a cylindrical shape.

Figure 3:
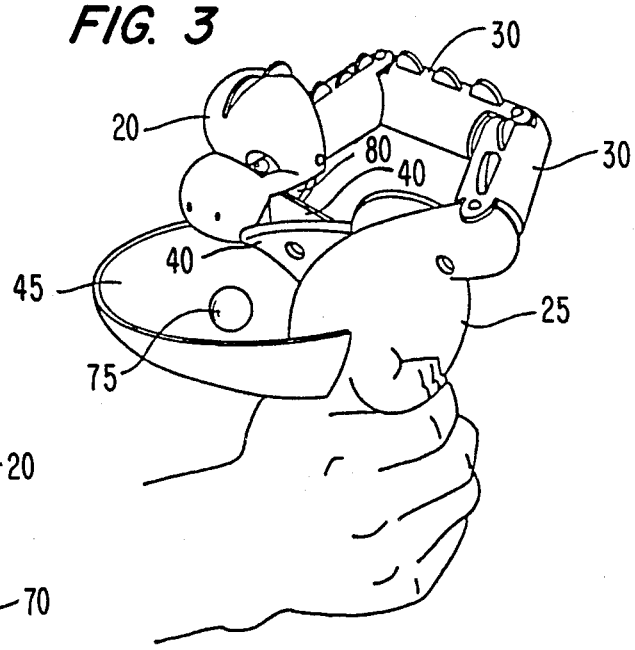
FIG. 3 is a perspective view of a game instrument embodying the present invention positioned to engage a protrusion member.

Each of the arm members 30 is pivotally connected an adjacent arm member 30 via pins 35. As shown in FIG. 2, the pins 35 join adjacent arm members 30 and are axially offset with respect to each other. While this offset is not necessary, it enables the arm members 30 to more easily pivot about the grip member 25 into a position such as illustrated in FIG. 3. In addition, the arm members 30 are connected to each other so that they gently curve from the grip member 25 to the open/close member 20. In other words, each of the arm members 30 has a longitudinal axis that is at an angle with respect to the longitudinal axis of an adjacent arm member. This curve in the arm assembly is shown in FIGS. 1 and 2 with the arm assembly 15 fully extended in a longitudinal direction. The curve ensures that the arm assembly 15 can easily pivot to the position shown in FIG. 3. As with the offset of the pins 35, the curve in the arm assembly 15 is not required, but merely makes it easier for the arm assembly 15 to pivot.

The grip member 25 has connected thereto a protrusion 40 and a receptacle 45. The protrusion 40 is positioned on the grip member 25 so as to engage the open/close member 20 when the game instrument 10 is in a position such as illustrated in FIG. 3.

Figure 4:
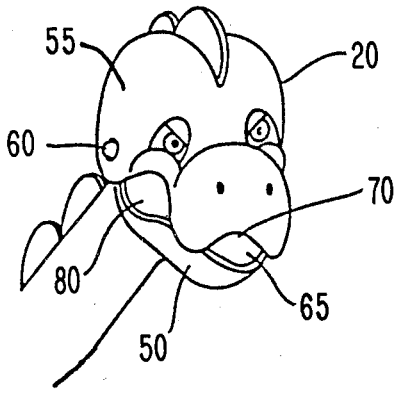
FIG. 4 illustrates an embodiment of an open/close member of the present invention.

Referring to FIG. 4, the open/close member 20 includes a first part 50 and a second part 55 that is pivotable with respect to the first part 50. The second part 55 pivots about pivot points 60 positioned on opposing sides of the open/close member 20. The pivot points 60 can be, for example, protrusions from the first part 50 or, for example, the ends of an axle. All that is needed is that the second part 55 freely pivot about the points 60 so as to enlarge or close an opening 65 by moving the first and second parts with respect to each other.

FIG. 4 illustrates the open/close member 20 in a closed position. In this closed position, a recess 70 in a portion of a second part 55 defines the size of the opening 65. So, when the recess 70 is brought to rest against a ball or marble 75 shown in FIG. 1, the second part 55 tends to rotate about the pivot points 60, causing the opening 65 to be enlarged and permitting the ball or marble 75 to enter the open/close member 20. When the game instrument 10 is in use as shown in FIG. 1, the weight of the second part 55 tends to hold it in the closed position. As shown in FIGS. 2 and 4, the first part 50 has a cup shape so that the ball or marble 75 tends to stay in the first part 50.

Referring to FIG. 4, the open/close member 20 also includes opposing openings 80 on either side of the open/close member 20. The opening 80 engage the protrusion 40 which has a wedge or triangular shape. As a protrusion 40 enters one of the opens 80, the second part of the open/close member 20 is urged open. This enlarges the opening 65 and enables the ball or marble 75 to drop out of the first part 50 into the receptacle 45. This is illustrated in FIG. 3, wherein a protrusion 40 is engaged with an opening 80, allowing the second part 55 to open and the ball or marble 75 to drop out into the receptacle 45.

To use the hand held game instrument of the present invention, a user holds the grip member 25 and places the opening 65 over a ball or marble 75. The engagement of the ball or marble 75 with the recess 70 causes the second part 55 to rotate, enlarging the opening 65 and permitting the ball or marble 75 to enter the open/close member 20. Lifting the hand held game instrument 10 causes the second part 55 to close due to its own weight, as noted above. This state is shown in FIG.

2. The respective functions of the first and second parts (50, 55) can be reversed, and the movable part could be spring biased if desired.

With the hand held game instrument holding a ball or marble 75 as shown in FIG. 2, the instrument is lifted toward a horizontal or slightly elevated position. Since, in the preferred embodiment, the pins 35 are offset and arm members 30 are connected to form a gentle curve, the open/close member 20 is slightly elevated above the grip member 25 when the grip member 25 is held approximately horizontal. As a result, the open/close member 20 tends to pivot towards the grip member 25. The open/close member 20 continues to pivot, and engages one of the protrusions 40 as shown in FIG. 3. As described above, this causes the second part 55 to freely lift and permits the ball or marble 75 to roll out of the first part 50 into the receptacle 75.

As shown in FIG. 2, the hand held game instrument 10 of the present invention can be used with a reservoir 85 to hold the balls or marbles 75. The reservoir 85 preferably has curved bottom causing the balls or marbles 75 to accumulate at the bottom of the reservoir 85.

While the present invention has been described with respect to a particular embodiment, the present invention is not limited to the specifically discussed embodiment. Instead, the present invention is defined by the attached claims.

What is claimed is:

1. A hand held game instrument comprising:

a grip member;

a receptacle connected to said grip member;

a protrusion connected to said grip member;

an open/close member comprising a first part and a second part pivotable with respect to said first part; and a plurality of arm members pivotally connected to each other, and connected between said grip member and said open/close member so that said open/close member pivots to engage said protrusion and to move said second part.

2. A hand held game instrument according to claim 1, wherein a first one of said arm members has a first end connected to said open/close member and a second end, and wherein the remaining ones of said arm members are pivotally connected between said second end and said grip member.

3. A hand held game instrument according to claim 2, wherein each of said arm members has a longitudinal axis, and said game instrument further comprises a plurality of pin members respectively positioned on corresponding ones of said arm members so that the longitudinal axis of adjacent ones of said arm members are at angles with respect to each other.

4. A hand held game instrument according to claim 3, wherein said protrusion has a wedge shape.

* * * * *